United States Patent [19]

Eschard

[11] Patent Number: 4,649,314

[45] Date of Patent: Mar. 10, 1987

[54] ELECTRON MULTIPLIER ELEMENT, ELECTRON MULTIPLIER DEVICE COMPRISING SAID MULTIPLYING ELEMENT, AND THE APPLICATION TO A PHOTOMULTIPLIER TUBE

[75] Inventor: Gilbert Eschard, Brive, France

[73] Assignee: U.S. Philips Corporation, New York, N.Y.

[21] Appl. No.: 628,704

[22] Filed: Jul. 9, 1984

[30] Foreign Application Priority Data

Jul. 11, 1983 [FR] France ..... 83 11514

[51] Int. Cl.[4] ..... H01J 43/00

[52] U.S. Cl. ..... 313/103 CM; 313/105 CM; 313/103 R

[58] Field of Search ..... 313/103 CM, 105 CM, 313/103, 105, 533, 532, 105 R

[56] References Cited

U.S. PATENT DOCUMENTS

| | | | |
|---|---|---|---|
| 2,872,721 | 2/1959 | McGee | 313/105 CM |
| 3,513,345 | 5/1970 | Feaster | 313/533 |
| 3,849,692 | 11/1974 | Beasley et al. | 313/105 CM |
| 3,914,634 | 10/1975 | Overall et al. | 313/105 CM |
| 4,023,063 | 5/1977 | King et al. | 313/105 CM |
| 4,041,343 | 8/1977 | Orthuber | 313/105 R |
| 4,071,474 | 1/1978 | Kishimoto | 313/105 CM |
| 4,482,836 | 11/1984 | Washington et al. | 313/105 CM |

FOREIGN PATENT DOCUMENTS

| | | | |
|---|---|---|---|
| 1352733 | 5/1974 | United Kingdom | 313/105 CM |

OTHER PUBLICATIONS

The American Heritage Dictionary, Second College Edition.

*Primary Examiner*—David K. Moore
*Attorney, Agent, or Firm*—F. Brice Faller

[57] ABSTRACT

Electron multiplier element (11) with secondary emission of the "apertured plate" type, characterized in that, on the one hand, it consists of a first plate (12) having holes (13), which are termed multiplier holes, in which each multiplier hole (13) defines on a first surface (14) of the said first plate (12) an aperture (15) which is termed input aperture and which is larger than the aperture (16), which is termed output aperture, which is defined on the second surface (17) of the first plate (12), and, on the other hand, consists of a second plate (22) which is parallel to the first plate (12), which also comprises holes (23) which are termed auxiliary holes the aperture (25) of which is situated on a first surface (24) of the second surface (22) opposite to the second surface (17) of the first plate (12), is substantially equal to the output aperture (16) of the multiplier holes (13) and is smaller than the aperture (26) of the said auxiliary holes (23) which are defined on the second surface (27) of the second plate (22), and that the said first plate (12) and second plate (22) are each insulated from each other, the second plate (22) being brought at a potential (V1) which is larger than the potential (Vo) of the first plate (12).

11 Claims, 14 Drawing Figures

ELECTRON MULTIPLIER ELEMENT, ELECTRON MULTIPLIER DEVICE COMPRISING SAID MULTIPLYING ELEMENT, AND THE APPLICATION TO A PHOTOMULTIPLIER TUBE

BACKGROUND OF THE INVENTION

The present invention relates to an electron multiplier element of the "apertured plate" type with secondary emission. The invention also relates to an electron multiplier device comprising a parallel stacking with N electron multiplier elements of secondary emission according to the invention and an application of said multiplier device to a photomultiplier tube.

An electron multiplier device as described in the opening paragraph is known, for example, from French Patent Specification No. 2,299,722. This Specification describes an electron multiplier tube which consists of a stack of electron multiplier elements with secondary emission, each formed by two apertured demi-plates having concave walls, the assembly being such that when the demi-plates are combined the corresponding holes of each demi-plate form a single barrel-shaped hole. The walls of said holes are coated with a layer of material with secondary emission in which the useful part of each single hole is formed by the lower half-hole. The advantage of such a structure of electron multiplier elements is that it enables the multiplication, with little space, of the incident electrons presenting themselves at the level of the plate in the form of a wide beam, for example a cylindrical beam, without it being necessary to use an electron focalization optical system. On the other hand, a recurring structure of small pitch is well suitable to form intensified pictures.

However, the disadvantage of this type of electron multiplier elements is that a significant number of incident electrons does not cause secondary emission because some of them directly traverse the multiplier holes without being subjected to multiplication while others reach the multiplier elements in places where the secondary electrons cannot be extracted, for example between two holes or beyond the effective part of the holes.

SUMMARY OF THE INVENTION

It is the object of the present invention to mitigate this disadvantage by increasing the capturing efficiency of the multiplier elements.

According to the present invention, an electron multiplier element with secondary emission of the "apertured plate" type is characterized in particular in that it consists of a first plate having holes which are termed multiplier holes and which are provided according to a regular flat pattern, each multiplier hole defining, on a first surface of the said plate, an aperture which is termed input aperture and which is larger than the aperture which is termed output aperture and which is defined on the second surface of the first plate, the input aperture of each multiplier hole being substantially tangent to the input apertures of the nearest neighbours of the said multiplier holes, and of a second plate which is parallel to the first plate and which also comprises holes which are termed auxiliary holes and the aperture of which on a first surface of the second plate which is present opposite to the second surface of the first plate is substantially equal to the output aperture of the multiplier holes and is smaller than the aperture of the said auxiliary holes which is defined on the second surface of the second plate and that the said first and second plates are electrically insulated from each other, the second plate being brought at a potential which is larger than the potential of the first plate. Because the input apertures are nearly tangent and the multiplier holes show an open semi-barrel-shaped structure, the first plate presents to the incident electrons an effective multiplier surface which is much larger than in the known apertured plates. The second plate, the so-called auxiliary holes of which have substantially the same shape as the output aperture of the multiplier holes, serves as an accelerating electrode.

The input and output apertures of the multiplier holes may be circular and the holes may be assembled according to a regular square or hexagonal plane pattern, said pattern having the advantage of increasing the effective multiplying surface of the first plate. In order to further increase the effective multiplier area, it is contemplated that the input aperture of the multiplier holes of the first plate should be substantially square or hexagonal and that the said regular plane pattern should be square or hexagonal.

It is also proposed that the output apertures of the multiplier holes of the first plate are shifted with respect to their input apertures so that the said multiplier holes are asymmetrical. The advantage of having the asymmetrical disposal of the multiplier holes consists of the spatial definition of the position of the effective multiplier part with respect to the output aperture of the multiplier holes and hence the orientation of the paths of secondary electrons according to their preferred direction.

The multiplier element according to the invention may preferably be used for the manufacture of an electron multiplier device having a high capturing efficiency. In accordance with the present invention an electron multiplier device having a parallel stack of N electron multiplier elements with secondary emission is characterized according to the invention in that the spacing between the second surface of the second plate of the $i^{th}$ multiplier element and the first surface of the first plate of the $(i+1)^{th}$ multiplier element is larger than the spacing which separates the first and second plates of the same multiplier element, and that the second plate of the $i^{th}$ multiplier element is at an electrical potential which is identical to the electrical potential of the first plate of the $(i+1)^{th}$ multiplier element. This pattern in which the multiplier elements are relatively spaced apart shows the advantage of a better capture of the electrons between one multiplier element and the next.

A special embodiment of the multiplier device in accordance with the invention consists in that the multiplier holes and auxiliary holes of the $(i+1)^{th}$ multiplier element are situated opposite to the multiplier holes and auxiliary holes of the $i^{th}$ multiplier element so that the corresponding multiplier holes and auxiliary holes of the N multiplier elements constitute rectilinear channels the direction of which is at right angles to the planes of the N multiplier elements. This embodiment has for its advantage that it enables the formation of intensified pictures when it is used in a tube of the image intensifier type, for the secondary electrons leaving a channel of the device are in principle originating only from the multiplication of the incident electrons penetrating into the channel.

If on the contrary the gain of the device according to the invention is desired to be even increased, but by renouncing the possibility of the formation of holes when the multiplier circuits are symmetrical, the multiplier holes and auxiliary holes of the $(i+1)^{th}$ multiplier elements have been shifted so with respect to the multiplier holes and auxiliary holes of the $i^{th}$ multiplier element that the corresponding multiplier holes and auxiliary holes of the N multiplier elements constitute rectilinear channels the direction of which encloses an acute angle to the normal on the surfaces of the N multiplier elements. A structure in which the multiplier holes are provided according to the five spots on a die in particular gives a very good efficacity of the assembly of the multiplier device in accordance with the invention. It is to be noted that a device having multiplying elements with asymmetrical holes enables to obtain simultaneously a good electronic efficiency as well as the possibility of forming pictures. In order to avoid the return of ions and light to the photocathode via the said rectilinear channels when the device according to the invention is provided in a photomultiplier tube, it is proposed that the multiplier holes and auxiliary holes of the $(i+1)^{th}$ multiplier element are shifted with respect to the multiplier holes and auxiliary holes of the $i^{th}$ multiplier element in such manner that the multiplier holes and corresponding secondary holes of the N multiplier elements constitute channels which describe a helix.

The electron multiplier device according to the invention is applied in a particularly favourable manner to a photomultiplier tube having a photocathode and at least one anode. In this application the multiplier device is placed between the photocathode and the anode and at least the known dynodes are partly replaced. This type of photomultiplier tube shows many advantages: large capture area, good linearity, velocity and little space.

A particular application of the photomultiplier device in accordance with the invention to a photomultiplier tube is characterized in particular in that the photomultiplier tube comprises n adjoining anodes, the said multiplier device is placed in the proximity of the photocathode and is divided into n secondary multiplier devices by partitions which are closed for the electrons and are situated opposite to the separation zones of the two successive anodes in such manner that n secondary photomultiplier tubes are realized in the same photomultiplier tube. Thus, each secondary photomultiplier provides to the output an electrical signal which is proportional to the light information which is received by the corresponding photocathode element. This type of tube is very suitable, for example for the localization of nuclear particles.

BRIEF DESCRIPTION OF THE DRAWING

The invention will be described in greater detail with reference to the accompanying drawings, in which.

DESCRIPTION OF THE PREFERRED EMBODIMENTS

Figure 1:
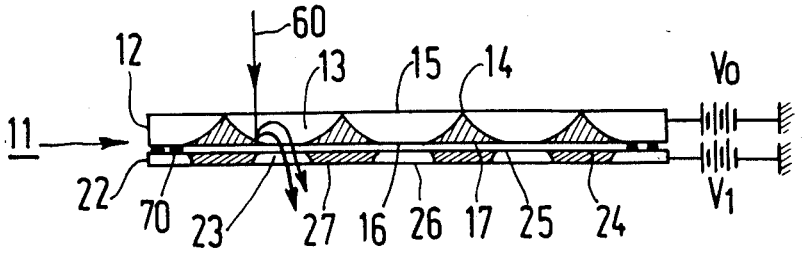
FIG. 1 is a sectional view of an embodiment of the multiplier element according to the invention.

FIG. 1 is a sectional view of an electron multiplier element 11 having secondary emission of the "apertured plate" type. As shown in FIG. 1, said multiplier element consists on the one hand of a first plate 12 having concave holes 13 which are termed multiplier holes and which are arranged according to a regular flat pattern. Each concave multiplier hole 13 defines on a first surface 14 of the first plate 12 an aperture or end 15 which is termed input aperture and which is larger than the aperture or end 16 which is termed output aperture and which is defined on the second surface 17 of the first plate 12, the input aperture 15 of each multiplier hole being substantially tangent to the input aperture of the nearest neighbours of the said multiplier hole; that is, edges of such input aperture ends contact or nearly contact each other. On the other hand, the multiplier element 11 comprises a second plate 22 which is parallel to the first plate 12 and which also comprises concave holes 23 which are termed auxiliary holes. The aperture or end 25 of each hole 23 lies on a first surface 24 of the second plate 22 and is situated opposite to the second surface 17 of the first plate 12, is substantially equal in diameter to the output aperture 16 of the multiplier hole 13 and is smaller than the aperture or end 26 of the auxiliary holes 23 which is defined on the second surface 17 of the second plate 22. As shown in FIG. 1, the said first plate 12 and the second plate 22 are electrically insulated from each other, the second plate 22 being brought to a potential V1 which exceeds the potential V0 of the first plate 12.

At least the first plate 12 is manufactured from a material which may give rise to secondary emission, such as a copper beryllium alloy, which has been subjected to the known processes: heating-migration of the beryllium and oxidation. This first plate 12 may also be manufactured from a less expensive material, for example mild steel, covered with a secondary emission material: a layer of oxydized copper-beryllium alloy or manganese oxide. As compared with the known electron multipliers of the "apertured plate" type, the multiplier element according to the invention provides a considerably larger capturing and multiplier surface to the incident electrons 60 on the side of the first surface 14 of the first plate 12. The electrical insulation of the two plates 12 and 22 may be done, for example, by means of small glass balls 70 having a diameter of 100 to 200 μm which are sealed at the circumference of the said plates. The second plate 22, the potential of which is higher than that of the first plate 12, plays the part of accelerating electrode.

Figure 2:
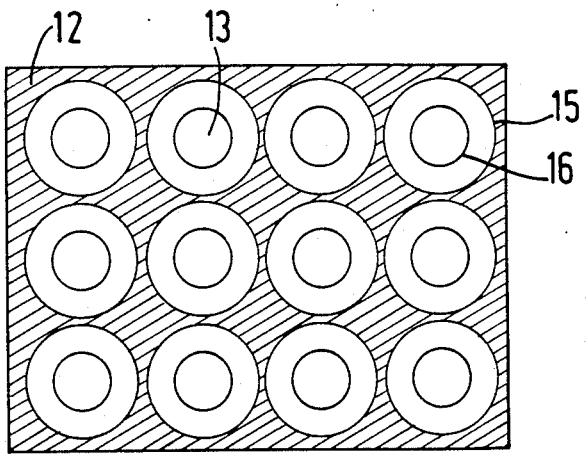
FIG. 2 is a plan view of the first plate of the multiplier element of FIG. 1.
Figure 3:
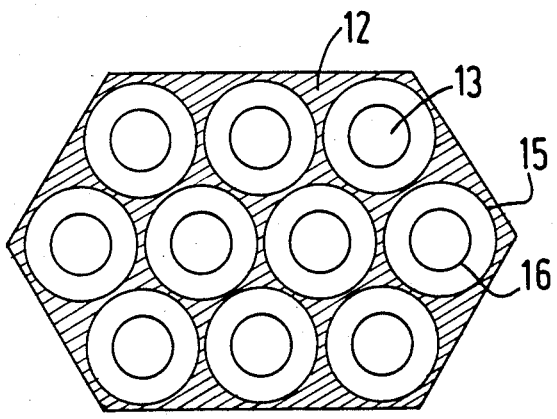
FIG. 3 is a plan view of a first modified embodiment of a first plate of the multiplier element according to the invention.

FIG. 2 is a plan view of the first plate 12 of the multiplier element 11 of FIG. 1. As shown in FIG. 2, the input aperture 15 and the output aperture 16 of the multiplier holes 13 are circular and the regular pattern is square. FIG. 3 shows a first modified embodiment of the plate shown in FIG. 2 by means of which the effective multiplier surface of the first plate can be enlarged. As shown in FIG. 3, the input aperture 15 and the output aperture 16 of the multiplier holes 13 of the first plate 12 are circular and the regular flat pattern is hexagonal.

Figure 4:
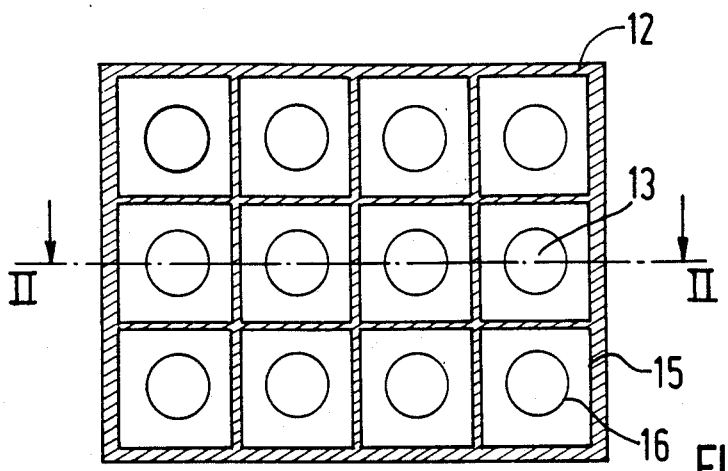
FIG. 4 is a plan view of a second modified embodiment of a first plate of the multiplier element according to the invention.
Figure 5:
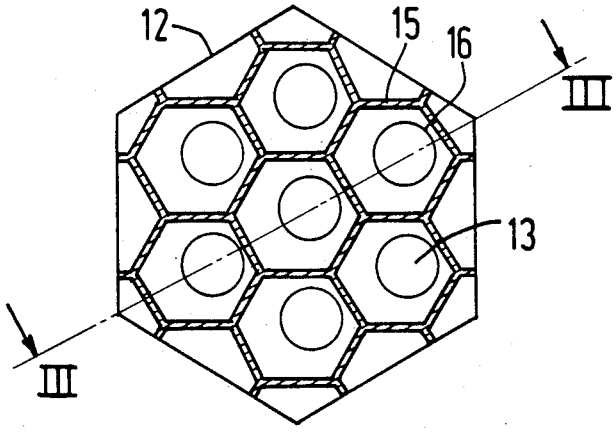
FIG. 5 is a plan view of a third modified embodiment of a first plate of the multiplier element according to the invention.

If it is desired to further enlarge the capturing and multiplier efficiency of the first plate, reference may be made to FIGS. 4 and 5 in which the input aperture 15 of the multiplier holes 13 of the first plate 12 are substantially square and hexagonal, respectively, and the regular flat pattern is square and hexagonal, respectively.

Figure 6:
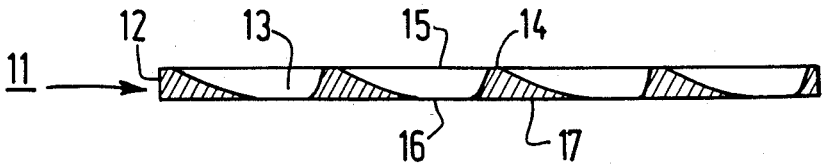
FIG. 6 is a sectional view taken on the line II—II of the multiplier element of FIG. 4 or III—III of FIG. 5.

FIGS. 5 and 6 show a third embodiment of the multiplier element according to the invention in which the output apertures 16 of the multiplier holes 13 of the first plate 12 are shifted with respect to their input apertures 15 in such manner that the said multiplier holes 13 are asymmetrical. The manufacture of such multiplier elements may be carried out by chemical etching on the two surfaces of a first metal plate through marks which are suitably shifted.

Figure 7:
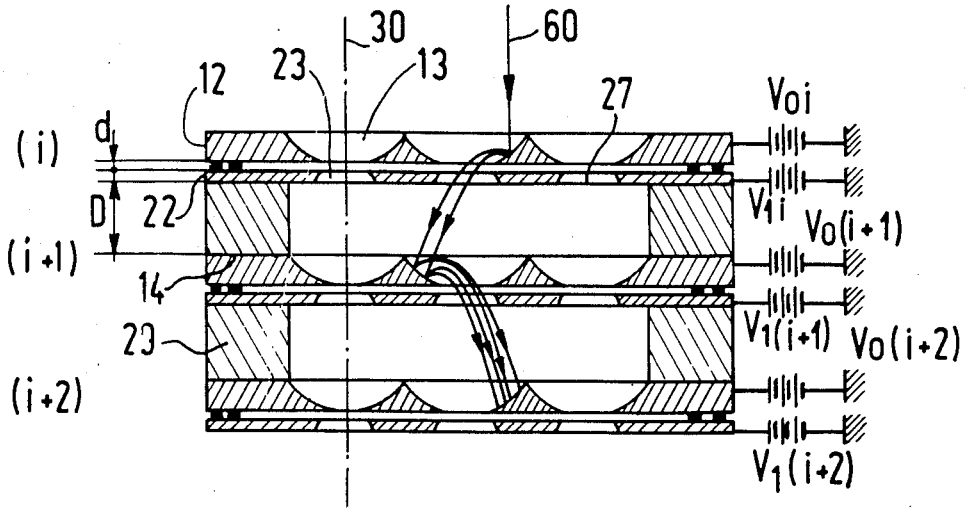
FIG. 7 is a sectional view of the multiplier device according to the invention which consists of multiplier elements which are analogous to those of FIG. 1.

FIG. 7 is a sectional view of an electron multiplier device having a parallel stack of N (in this case N=3) multiplier elements which are analogous to that shown in FIG. 1. As shown in FIG. 7, the distance D between the second surface 27 of the second plate 22 of the $i^{th}$ multiplier element and the first surface 14 of the first plate 12 of the $(i+1)^{th}$ multiplier element is larger than the distance d separating the first plate 12 and the second plate 22 of the same multiplier element. On the other hand, the second plate 22 of the $i^{th}$ multiplier element of the electric potential V1i is identical to the electric potential Vo(i+1) of the first plate 12 of the $(i+1)^{th}$ multiplier element. The multiplier device according to the invention has a better capturing efficiency than the known devices due to the good capturing efficiency of each multiplier element and also due to the spacing effect between the two successive multiplier elements.

The multiplier elements are kept at the distance D from each other by spacing members 29 which are provided on the circumference of the plates.

In the FIG. 7 embodiment the multiplier holes 13 and auxiliary holes 23 of the $(i+1)^{th}$ multiplier element are situated opposite to the multiplier holes and auxiliary holes of the $i^{th}$ multiplier element in such manner that the corresponding multiplier holes and auxiliary holes of N multiplier elements constitute rectilinear channels the direction 30 of which is at right angles to the surfaces of N multiplier elements. This embodiment of the multiplier device according to the invention presents the advantage that it can be used in a tube of the image intensifier type, for the secondary electrons which come from a channel of the device originate from the multiplication of the incident electrons 60 penetrating into the same channel.

Figure 8:
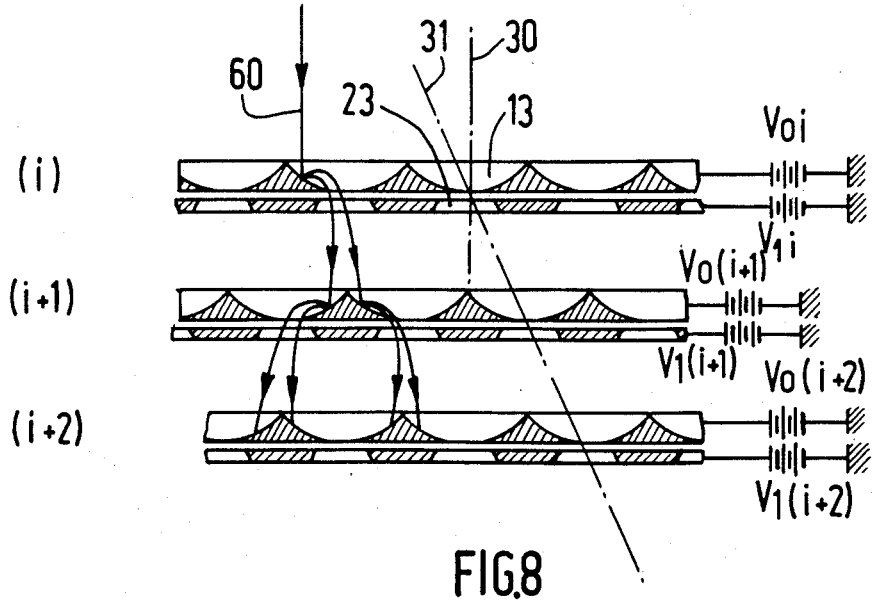
FIG. 8 is a sectional view of a modified embodiment of the multiplier device shown in FIG. 7.

FIG. 8 is a sectional view of an embodiment of the multiplier device shown in FIG. 7 in which modified embodiment the centers of output ends of multiplier holes 13 and the centers of first ends of auxiliary holes 23 of the $(i+1)^{th}$ multiplier element are substantially offset with respect to the centers of output ends of multiplier holes and the centers of first ends of auxiliary holes of the $i^{th}$ multiplier element in such manner that the corresponding multiplier holes and auxiliary holes of the N multiplier elements constitute rectilinear channels the centerline 31 of which forms an acute angle with the normal 39 to the surfaces of the N multiplier elements. This embodiment increases the gain of the multiplier device according to the invention, for incident electrons which traverse a multiplier element in the centre of a multiplier hole, hence without multiplication, would then be multiplied by the next multiplier element whereas they would not in the FIG. 7 embodiment. On the other hand, as shown in FIG. 8, the device shown cannot be used for the formation of pictures for there is no unambiguous agreement between a given multiplier hole of the $i^{th}$ multiplier element and a multiplier hole of the $N^{th}$ and last multiplier element.

Figure 9:
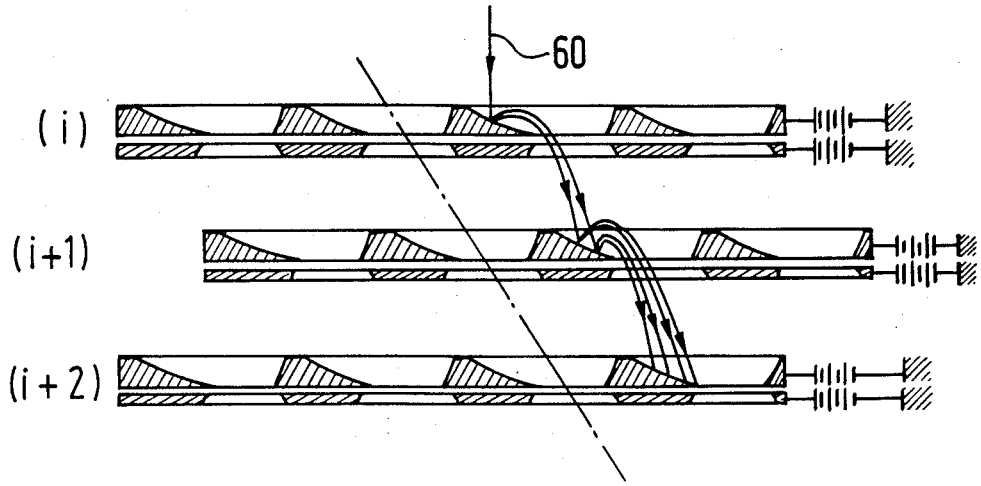
FIG. 9 is a sectional view of the multiplier element according to the invention consisting of multiplier elements which are analogous to those of FIG. 6.
Figure 10:
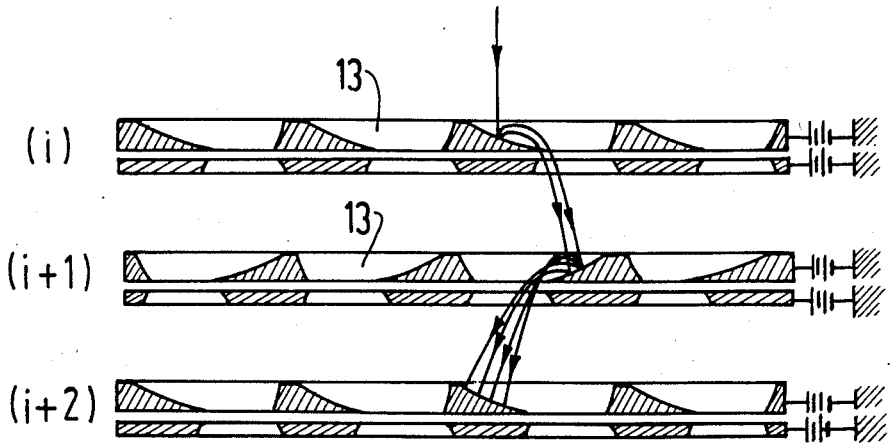
FIG. 10 is a sectional view of a modified embodiment of the multiplier device shown in FIG. 9.

However, it is possible to obtain both a good electron efficiency and the possibility to form pictures by using the multiplier elements with asymmetric multiplier holes, as they are shown in FIG. 6. This is the case with the multiplier device shown in FIG. 9. In order to avoid the shift between the input picture and the output picture, which shift may be important if the number of N multiplier elements is large, it is ensured, as shown in FIG. 10, that the asymmetrical multiplier elements 13 of the $(i+1)^{th}$ multiplier element are in a head-tail configuration with respect to the asymmetric multiplier holes of the $i^{th}$ multiplier element. That is, the centers of the output ends of multiplier holes of alternate multiplier elements and substantially aligned. The centerline therethrough being substantially coincident with the normal to the surfaces.

Figure 11A:
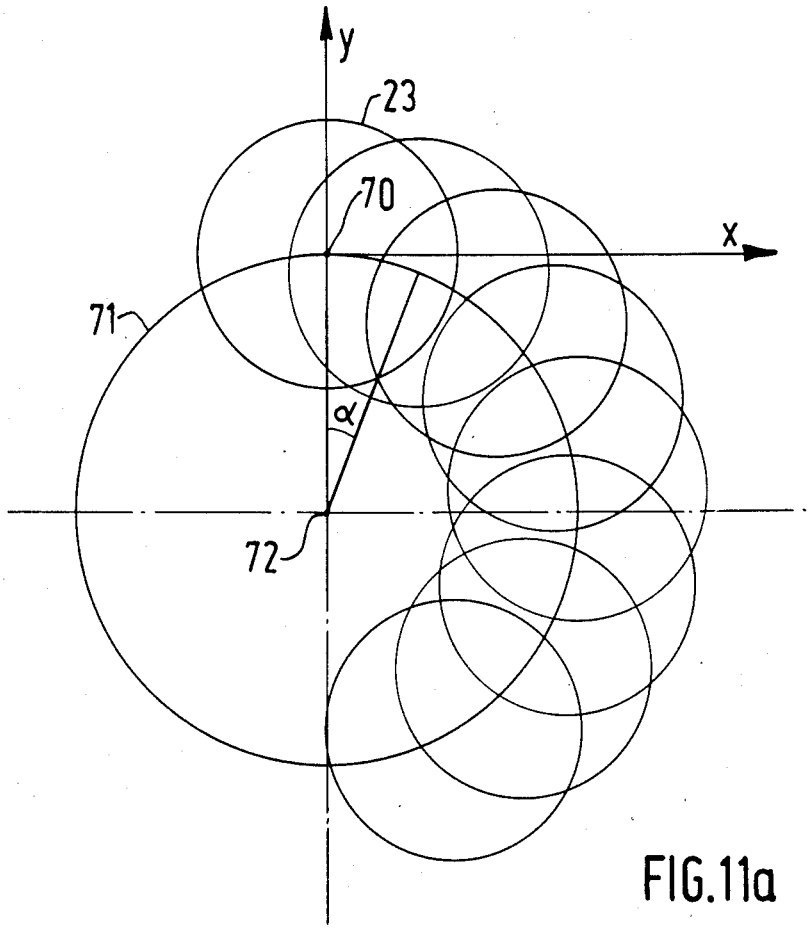
FIG. 11*a* is a diagram which gives the realization principle of the multiplier device according to the invention, the multiplier elements of which are assembled according to a hexlix.

In order to avoid ions or light from going to the photocathode via the rectilinear holes in the case in which the device according to the invention forms part of a photomultiplier tube, it has been proposed, with reference to FIG. 11*a*, that the multiplier holes 13 and the auxiliary holes 23 of the $(i+1)^{th}$ multiplier element are shifted with respect to the multiplier holes and auxiliary holes of the $i^{th}$ multiplier element in such manner that the multiplier holes and corresponding secondary holes of the N multiplier elements constitute channels which describe a helix.

Figure 11B:
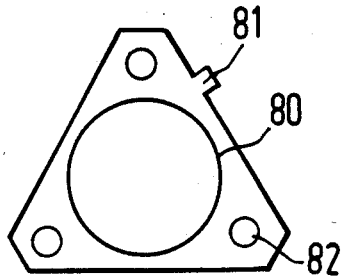
FIG. 11*b* shows a multiplier element in a form which is suitable for application of the realization principle which is illustrated in FIG. 11*a*.

The axes (x, y) of the N multiplier elements remain parallel to each other but the centres 70 of the reference multiplier holes 23 are regularly distributed on a given circle 71. The centres 70 of the two successive holes 23 enclose a given angle α with its apex at the centre 72 of the circle 71 and the magnitude of which depends on the overall number N of the multiplier elements. FIG. 11*b* is a plan view of a plate of a triangular multiplier element the effective part of which is indicated by the circle 80. This plate has an electrical connection pad 81 and is perforated with three holes 82 for assembling the plates of the multiplier elements by means of small columns which pass through the holes 82. The helical shift is obtained by shifting the position of the three holes 82 in the opposite direction after having determined the origin of the axes (x, y) by connection discs which penetrate into the multiplier holes or auxiliary holes of the central zone 80.

Figure 12:
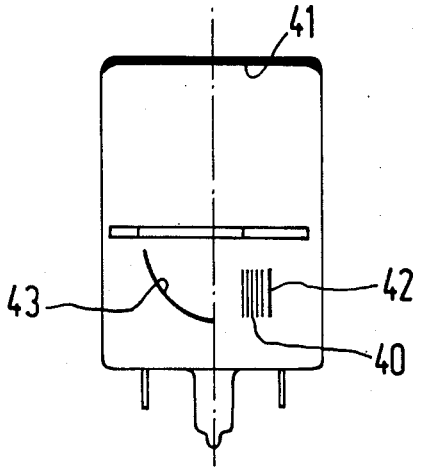
FIG. 12 is a sectional view of a photomultiplier tube having a photomultiplier device according to the invention.

The electron multiplier device according to the invention finds a particularly useful application in photomultiplier tubes. As shown in FIG. 12, the photomultiplier tube comprises a photocathode 41, an anode 42; the multiplier device 40 according to the invention is placed between the photocathode 41 and the anode 42 in which the input aperture 15 of the multiplier holes is directed (via dynode 43) towards the photocathode 41. In the FIG. 12 example the tube has a first dynode 43 which may have large dimensions, hence a larger capturing efficiency, as well as a better linearity, a higher velocity and a smaller space occupation.

Figure 13:
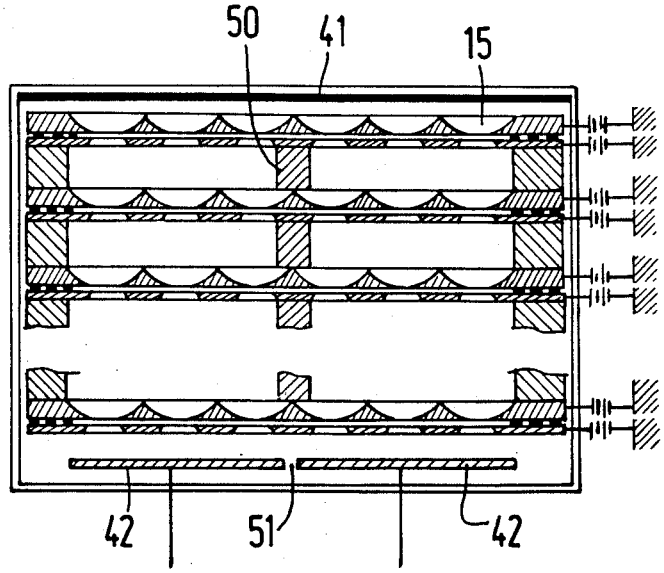
FIG. 13 is a sectional view of a photomultiplier tube consisting of secondary photomultipliers which are constituted by sections of a multiplier device according to the invention.

FIG. 13 is a sectional view of another application of the invention ot a photomultiplier tube having n adjoining anodes 42. In this application the multiplier device is placed in the proximity of the photocathode 41 and is distributed in n secondary multiplier devices by columns 50 which are closed for the electrons and are present opposite to the separation zones 51 of the two successive anodes 42 in such manner that n secondary multiplier tubes are formed in the same photomultiplier tube. The tubes of the FIG. 13 type find a favourable application in nuclear physics because they enable an accurate localization of the detected particles.

The closed partitions 50 may be manufactured in known manner by masking and photoetching of a metal plate.

What is claimed is:

1. An electron multiplier element of the apertured plate type, comprising a first secondary emission plate having front and rear major surfaces as considered in the direction of electron propagation, and through multiplier holes each having an input and an output end which respectively open into said front and rear major surfaces, said input end having a cross-sectional area that is larger than the cross-sectional area of said output end, and said input ends being distributed in a regular flat pattern substantially tangent to one another, said output ends being distributed in a like regular flat pattern which is shifted from the pattern of said input ends, a second plate parallel to said first plate and having first and second major surfaces as considered in the direction of electron propagation, and through auxiliary holes each having a first and a second end which respectively open onto said front and rear major surfaces, said first end being aligned with said output end and having a cross-sectional area that is substantially equal to that of said output end and smaller than the cross-sectional area of said second end, and means directly interposed between said rear and first surfaces for electrically insulating said first and second plates from one another, whereby upon application to said first plate of a first electric potential and to said second plate of a second electric potential which exceeds said first electric potential, electrons incident upon said first plate input ends are multiplied and pass through said auxiliary holes.

2. The element as defined in claim 1, wherein said input and output ends of said multiplier holes are circular and said regular flat pattern is square.

3. The element as defined in claim 1, wherein said input and output ends of said multiplier holes are circular and said regular flat pattern is hexagonal.

4. The element as defined in claim 1, wherein said input ends of said multiplier holes are substantially square and said regular flat pattern is square.

5. The element as defined in claim 1, wherein said input ends of said multiplier holes are substantially hexagonal and said regular flat pattern is hexagonal.

6. An electron multiplier device comprising a plurality of identical electron multiplier elements arranged in a stack, each element comprising a first secondary emission plate having front and rear major surfaces as considered in the direction of electron propagation, and through multiplier holes each having an input and an output end which respectively open onto said front and rear major surfaces, said input end having a cross-sectional area that is larger than the cross-sectional area of said output end, and said input ends being distributed in a regular flat pattern substantially tangent to one another, said output ends likewise being distributed in a regular flat pattern, a second plate parallel to said first plate and having first and second major surfaces as considered in the direction of electron propagation, and through auxiliary holes each having a first and a second end which respectively open onto said front and rear major surfaces, said first end being aligned with said output end and having a cross-sectional area that is substantially equal to that of said output end and smaller than the cross-sectional area of said second end, the centers of the output ends of the multiplier holes of each succeeding electron multiplier element being substantially offset from the centers of the output ends of the multiplier holes of the immediately preceding electron multiplier element thereby forming a rectilinear channel the center line of which forms an acute angle with the normal to the surface of the respective multiplier elements, and means directly interposed between said rear and first surfaces for electrically insulating said first and second plates from one another, said device further comprising means for spacedly mounting said electron multiplier elements such that a free-space distance exists between said second major surface of said second plate of a respective preceding electron multiplier element and said front surface of said first plate of the immediately succeeding electron multiplier element and exceeds the distance between said rear and first surfaces of said first and second plates of each of said electron multiplier element.

7. The device as defined in claim 6, wherein said multiplier and auxiliary holes of each succeeding electron multiplier element are so shifted with respect to said multiplier and auxiliary holes of the immediately preceding electron multiplier element as to collectively form helical channels.

8. A photomultiplier tube incorporating the arrangement of claim 6, further comprising a photocathode and at least one anode; and wherein said arrangement is situated between said photocathode and said anode in such an orientation that said input ends of said multiplier holes are directed toward said photocathode.

9. The photomultiplier tube as defined in claim 8, wherein said arrangement is disposed in the proximity of said photocathode; further comprising a plurality of additional anodes similar to and adjoining said anode and a plurality of electron-impermeable partitioning walls situated in said arrangement in alignment with the spaces between said anodes to subdivide said arrangement into a plurality of separate parallel electron multiplier sub-arrangements.

10. An electron multiplier device as in claim 6 wherein the output ends of the multiplier holes in each element are distributed in a like regular flat pattern as said input ends, said like pattern being offset from the pattern of said input ends, said multiplier holes being asymmetric.

11. An electron multiplier device as in claim 6 wherein the centers of the output ends of the multiplier holes of alternate electron multiplier elements are substantially aligned, the centerline therethrough being substantially coincident with the normal to the surfaces.

* * * * *